US008459967B2

(12) United States Patent
Kleber

(10) Patent No.: US 8,459,967 B2
(45) Date of Patent: Jun. 11, 2013

(54) AXIAL FLOW FAN, IN PARTICULAR FOR A MOTOR VEHICLE

(75) Inventor: Andreas Kleber, Marbach (DE)

(73) Assignee: Behr GmbH & Co. KG, Stuttgart (DE)

( * ) Notice: Subject to any disclaimer, the term of this patent is extended or adjusted under 35 U.S.C. 154(b) by 313 days.

(21) Appl. No.: 12/751,511

(22) Filed: Mar. 31, 2010

(65) Prior Publication Data

US 2010/0247351 A1 Sep. 30, 2010

(30) Foreign Application Priority Data

Mar. 31, 2009 (DE) ..... 10 2009 015 104

(51) Int. Cl.
*F04D 19/00* (2006.01)

(52) U.S. Cl.
USPC ..... 417/423.14

(58) Field of Classification Search
USPC ..... 417/364, 423.1, 423.14, 353, 354; 415/208.1–208.5, 211.1, 211.2
See application file for complete search history.

(56) References Cited

U.S. PATENT DOCUMENTS

| | | | | |
|---|---|---|---|---|
| 2,900,128 | A * | 8/1959 | Piper, Jr. et al. | 415/211.2 |
| 5,489,186 | A * | 2/1996 | Yapp et al. | 415/58.7 |
| 6,195,983 | B1 * | 3/2001 | Wadia et al. | 60/226.1 |
| 6,827,547 | B2 * | 12/2004 | Robb | 415/1 |
| 6,863,496 | B2 * | 3/2005 | Cho et al. | 415/173.5 |
| 2002/0004008 | A1 * | 1/2002 | Miyata | 415/206 |
| 2002/0067988 | A1 | 6/2002 | Angelis | |
| 2006/0216147 | A1 * | 9/2006 | Park | 415/220 |
| 2008/0035316 | A1 * | 2/2008 | Blass et al. | 165/121 |
| 2009/0269195 | A1 * | 10/2009 | Hsu et al. | 415/208.2 |
| 2010/0303617 | A1 * | 12/2010 | Chen | 415/208.2 |
| 2010/0329855 | A1 * | 12/2010 | Tembreull et al. | 415/175 |

FOREIGN PATENT DOCUMENTS

| | | | |
|---|---|---|---|
| DE | 201 18 939 | U1 | 5/2002 |
| DE | 203 17 171 | U1 * | 3/2004 |
| DE | 20317171 | U1 * | 3/2004 |
| DE | 10 2006 037 628 | A1 | 2/2008 |
| EP | 1 443 216 | A2 | 8/2004 |

OTHER PUBLICATIONS

DE20317171U1 (machine translation).*

* cited by examiner

*Primary Examiner* — Devon Kramer
*Assistant Examiner* — Andrew A Horton
(74) *Attorney, Agent, or Firm* — Muncy, Geissler, Olds & Lowe, PLLC

(57) ABSTRACT

An axial flow fan is provided that is arranged in a rotatable manner around an axis in a stationary shroud ring, with fan blades. The shroud ring has an essentially cylindrical annular surface with an axial extension from a leading edge to a trailing edge and the fan blades have an axial depth from an inflow edge to an outflow edge. The outflow edges of the fan blades in an axial direction project beyond the trailing edge of the annular surface and form a blade overhang and flow guidance elements are arranged radially outside the fan blades as well as in the axial region of the blade overhang.

21 Claims, 3 Drawing Sheets

AXIAL FLOW FAN, IN PARTICULAR FOR A MOTOR VEHICLE

This nonprovisional application claims priority under 35 U.S.C. §119(a) to German Patent Application No. DE 10 2009 015 104.4, which was filed in Germany on Mar. 31, 2009, and which is herein incorporated by reference.

BACKGROUND OF THE INVENTION

1. Field of the Invention

The invention relates to an axial flow fan.

2. Description of the Background Art

Axial flow fans are used as blowers in motor vehicles, wherein the axial flow fan is arranged in the direction of air flow downstream of a heat exchanger or a group of heat exchangers and suctions ambient air through the heat exchanger or heat exchangers for cooling purposes. The axial flow fan runs in a shroud ring, i.e., a stationary case, wherein the shroud ring is part of a shroud or a fan cowl, which adjoins the heat exchanger or the group of heat exchangers. The internal combustion engine of the motor vehicle as well as additional units of the internal combustion engine are arranged downstream of the axial flow fan in the direction of air flow, i.e., in its outflow field, which form non-uniform obstacles in the outflow field of the axial flow fan. Due to the customary compact construction in the engine compartment of the motor vehicle, these obstacles, in particular the internal combustion engine are arranged at a small axial distance behind the axial flow fan, whereby effects of a blocking can result, in particular a pressure loss through a greater throttling, but also a pressure increase through diffuser effect. Furthermore, the air flow exiting the axial flow fan is affected by a swirl, which cannot be used for an additional pressure buildup—in fact the energy associated therewith is dissipated. Finally, the problem of recirculation also frequently occurs, i.e., the induction again of heated air that has exited from the axial flow fan. This leads to a deterioration of the cooling capacity.

Due to these problems, it has already been proposed that the outflow field of the axial flow fan should be influenced in a targeted manner, i.e., by a so-called outlet guide device or outlet guide elements.

In EP 1 443 216 A2, which corresponds to U.S. Pat. No. 6,827,547 B2, a cooling system for an internal combustion engine of a motor vehicle is disclosed, wherein a diffuser as well as exit-side flow guidance elements are arranged downstream of an axial flow fan circulating in a shroud ring. The shroud ring, which adjoins a fan cowl or shroud, encases the fan blades of the axial flow fan over their entire depth (axial extension), and the flow guidance elements running essentially in the radial direction are arranged downstream of the outflow edges of the fan blades in the direction of air flow, i.e., upstream of the fan exit plane. Thus a relatively large axial construction depth proves to be a disadvantage, since the depth of the fan blades and the depth of the flow guidance elements add up in the axial direction.

Through the applicant's DE 10 2006 037 628 A1, which is herein incorporated by reference, an outlet guide device for an axial flow fan arranged in a stationary manner is disclosed, which is arranged between a heat exchanger embodied as a coolant radiator and an internal combustion engine. The outlet guide device comprises on the one hand a diffuser and on the other hand flow guidance elements running essentially radially, which extend from the root of the fan blades to the outer diameter of the diffuser. The radial flow guidance elements and the diffuser are arranged downstream of the fan exit plane, so that that a relatively large axial construction depth results here too. This also applies to a further exemplary embodiment, in which flow guidance elements running radially are arranged radially outside the fan and the shroud ring.

SUMMARY OF THE INVENTION

It is therefore an object of the present invention to improve an axial flow fan with respect to its fan capacity, in particular through the targeted influence of its outflow field, wherein at the same time a compact construction in the axial direction is to be achieved.

In an embodiment of the invention, the fan blades can form a blade overhang with respect to the shroud ring and that flow guidance elements are arranged radially outside the fan blades and in the region of the blade overhang. The blade tips of the fan blades are thus not encased by the shroud ring in their outflow-side region, the region of the blade overhang, but run freely in this region. A fan outflow directed radially already forms in the blade tip region due to the blade overhang, which fan outflow strikes the flow guidance elements arranged radially outside. The advantage is thus achieved that the flow generated by the fan in the blade tip region is delayed, that the swirl is removed from the fan outflow and converted into static pressure (pressure recovery). The energy of the swirl flow in the fan outflow field is therefore not lost.

According to an embodiment, the flow guidance elements can be essentially aligned radially, or they have a radial and tangential course. The fan outlet air can thus be guided out of the engine compartment in a manner more free of losses. The conversion of the swirl flow into static pressure is caused hereby, and the air flowing away is advantageously dissipated.

The flow guidance elements can have curved guide surfaces, wherein a two-dimensional curvature or also a three-dimensional curvature can be advantageous. Two-dimensional curvature means that parallel radial sections have the save curvature—as in the case of a cylinder surface, for example. Three-dimensional curvature means that parallel radial sections through the flow guidance surfaces do not have the same curvature but different curvatures. For example, the flow guidance surfaces are additionally twisted in the axial direction.

According to an embodiment, the flow guidance elements can be arranged distributed on the circumference in sections or in groups. For example, a first group of flow guidance elements can be arranged above the fan, while a second group of flow guidance elements is arranged approximately diametrically to the first group, i.e., in the lower fan region. The selective arrangement and the individual geometry of the flow guidance elements is thereby carried out in a manner adapted to the local outflow field, i.e., the arrangement and embodiment of the obstructions to flow located upstream, such as the internal combustion engine and the additional units thereof. A high efficiency is thereby achieved in the reduction of pressure losses with minimal structural expenditure.

According to a further embodiment, the flow guidance elements with their trailing edges can be flush with the outflow edges of the fan blades. A gain in terms of axial installation space is achieved thereby, since the flow guidance elements are thus arranged within the axial depth of the fan blades. Particularly preferably, the axial depth of the flow guidance elements corresponds to the blade overhang. An optimal interaction of the blade tip flow with the flow guidance elements is thus produced.

According to a further embodiment, the exit side of the shroud ring can be embodied as a diffuser. A further pressure recovery is thus achieved through the delay of the fan exit flow, wherein the flow guidance elements and the diffuser support one another in their effectiveness.

The flow guidance elements can be attached to the shroud ring, which is possible without major structural expenditure. Particularly preferably, the flow guidance elements can be integrated into the shroud ring and embodied in one piece therewith, preferably as a plastic injection molded part or as injected assemblies screwed onto a metal ring.

In a further embodiment, the axial flow fan can be attached to the internal combustion engine of a motor vehicle and is driven by the internal combustion engine, for example, directly by the crankshaft or via an intermediate drive. The axial flow fan is thus arranged in an engine-mounted manner, which is advantageous in particular with commercial vehicles.

According to a further embodiment, the shroud ring and the flow guidance elements can also be attached to the internal combustion engine. Thus no relative movements or only slight relative movements occur between the fan blade tips and the shroud ring, so that a minimal peripheral gap can be realized, which is beneficial for the efficiency of the fan.

According to an embodiment, the axial flow fan, the shroud ring and the flow guidance elements can be attached to a shroud or fan cowl of a heat exchanger, preferably a coolant radiator of an internal combustion engine of a motor vehicle, i.e., the axial flow fan is arranged in a "radiator-fixed" manner. The axial flow fan is thereby preferably driven by an electric motor, which in turn is attached to the fan cowl. The radiator-fixed arrangement is advantageous for axial flow fans with a lower weight, i.e., for smaller vehicles.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figures 1A, 1B, 1C:
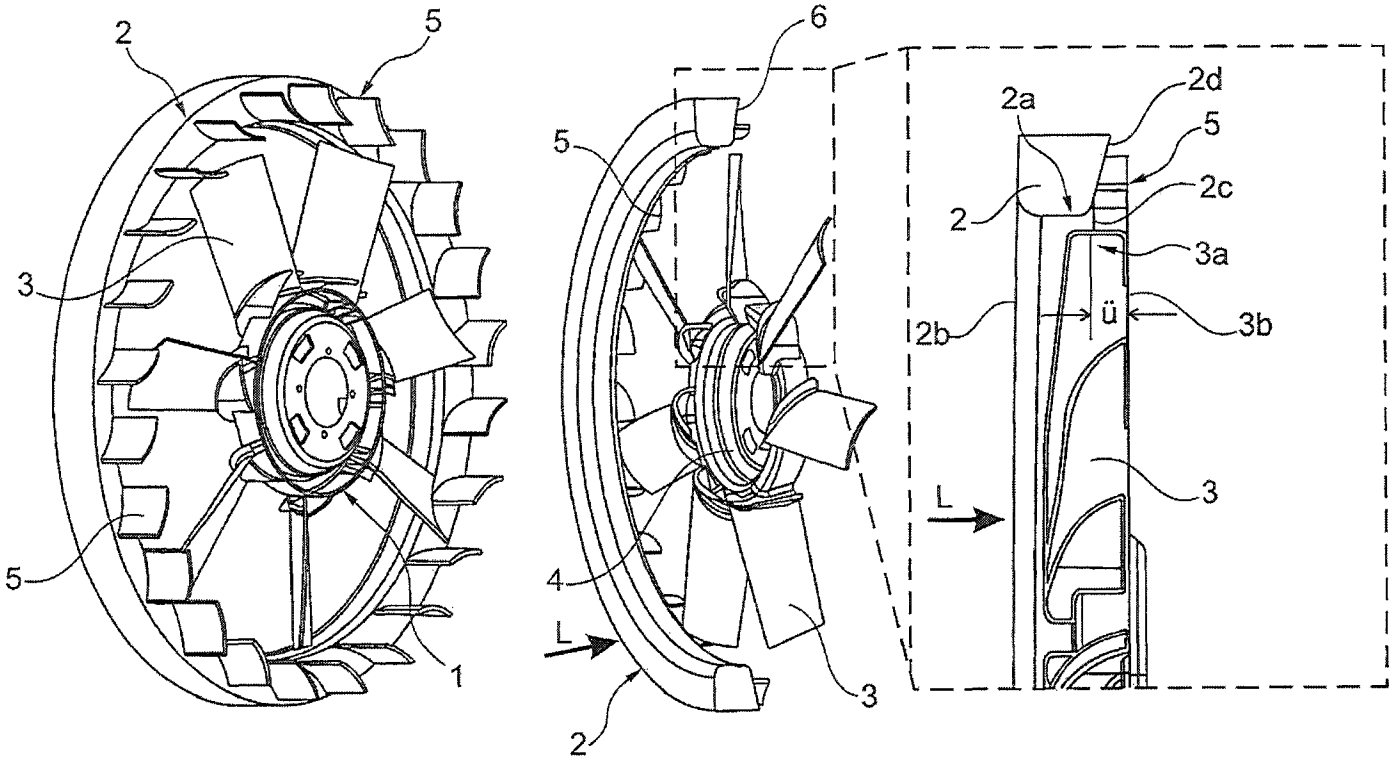
FIG. 1*a* illustrates an axial flow fan with flow guidance elements on a shroud ring in a view from the rear.
FIG. 1*b* illustrates the axial flow fan according to FIG. 1*a* in a side view.
FIG. 1*c* is an enlarged detail of the axial flow fan according to FIG. 1*b* as a section image.

FIGS. 1*a*, 1*b*, 1*c* show as a first exemplary embodiment of the invention an axial flow fan 1, which is arranged in a rotatable manner in a shroud ring 2 (also referred to as a diffuser ring or casing) arranged in a stationary manner. The axial flow fan 1 comprises fan blades 3 embodied as axial vanes as well as a fan hub 4, which is connected to a fan clutch (not shown), preferably a viscous friction clutch. The axial flow fan 1, also referred to below as fan 1 for short, is attached with respect to an internal combustion engine (not shown) of a motor vehicle and is driven by the internal combustion engine, preferably directly, i.e., via a crankshaft (not shown) of the internal combustion engine. An indirect drive via an intermediate drive embodied, for example, as a variable belt drive is likewise possible. The axial flow fan 1 is thus arranged in an engine-mounted manner. The shroud ring 2 has an annular surface 2*a* embodied essentially in a cylindrical manner, which partially encases the fan blades 3 in the axial direction, i.e., in the direction of the fan axis. The annular surface 2*a* is delimited in the axial direction (FIG. 1*c*) by a leading edge 2*b* and a trailing edge 2*c*. The fan 1 and the shroud ring 2 are flowed through by ambient air in the direction of an arrow L (FIG. 1*b*). Flow guidance elements 5 are arranged distributed over the circumference on the outflow side of the shroud ring 2, the rear side 2*d*, which flow guidance elements have a two-dimensional curvature around axially parallel axes. The flow guidance elements 5 form vane-like cylindrical surfaces running in the radial and tangential direction. In the exemplary embodiment shown (FIG. 1*a*), the flow guidance elements 5 are arranged distributed uniformly over the circumference.

As can be seen in particular in FIG. 1*c*, the rear side 2*d* of the shroud ring 2 is embodied in a conical manner and thus forms a diffuser 6 for the air flow exiting the fan 1. The fan blades 3 have outflow edges 3*b*, which project in the air flow direction L beyond the shroud ring 2. The spacing between the trailing edge 2*c* of the annular surface 2*a* and the outflow edge 3*b* of the fan blades 3 is termed the blade overhang ü. The blade tips 3*a* are therefore not encased by the annular surface 2*a* in the region of the blade overhang ü, but are arranged in a free running manner. The flow guidance elements 5 are arranged in the axial region of the blade overhang ü and have trailing edges 5*a*, which are flush with the outflow edges 3*a*, i.e., the outflow edges 3*b* of the fan blades 3 and the trailing edges 5*a* of the flow guidance elements 5 lie in a common radial plane. This means that the flow guidance elements 5 with respect to the (axial) depth of the fan blades 3 do not take up any additional axial installation space. The blade overhang preferably amounts to 15 to 60% of the entire depth of the fan blades 3.

According to an embodiment, the shroud ring 2 and the flow guidance elements 5 can be embodied in one piece, in particular as a plastic injection molded part.

The action of the axial flow fan 1 is described below in connection with the shroud ring 2 and the flow guidance elements 5, wherein reference is made in particular to the representation in FIG. 1*c*. The air entering the shroud ring 2 according to the arrow direction L meets the rotating fan blades 3 driven by the internal combustion engine. The internal combustion engine (not shown) is located downstream of the fan 1 in the flow direction, by which internal combustion engine a free outflow is obstructed. This leads to a throttling and a flow embodied in an approximately semiaxial manner in the fan 1. An outflow directed in a radial manner is formed in particular in the region of the blade tips 3*a*, which project beyond the trailing edge 2*c* of the annular surface 2*a* and thus run freely, which outflow meets the flow guidance elements 5. The air flow exiting via the blade tips 3*a* is affected by a strong swirl, which is removed from the air flow by the flow guidance elements 5 arranged in a stationary manner and is converted into static pressure. At the same time, a controlled delay of the outflow occurs as a result of the diffuser 6. The fan outflow is thus deflected in the radial direction. A pressure recovery and thus a higher fan capacity are achieved through the conversion of the dynamic pressure into static pressure.

Figure 2B:
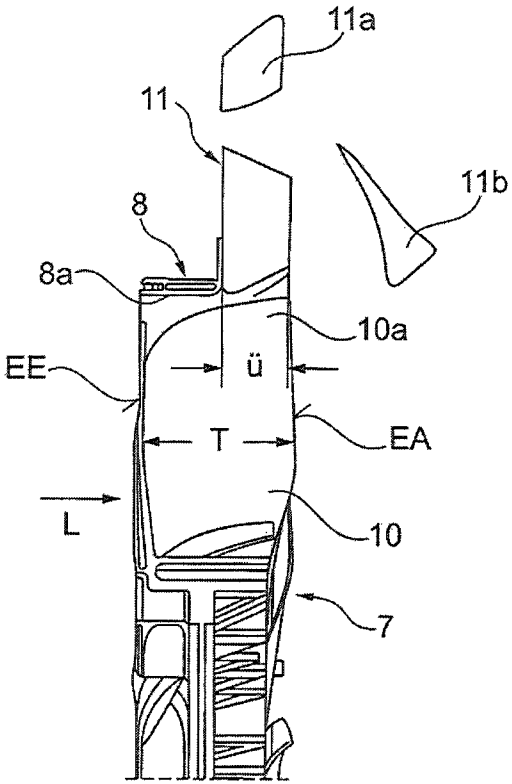
FIG. 2*b* is an axial section of the axial flow fan according to FIG. 2*a* with a flow guidance element in three views.
Figure 2A:
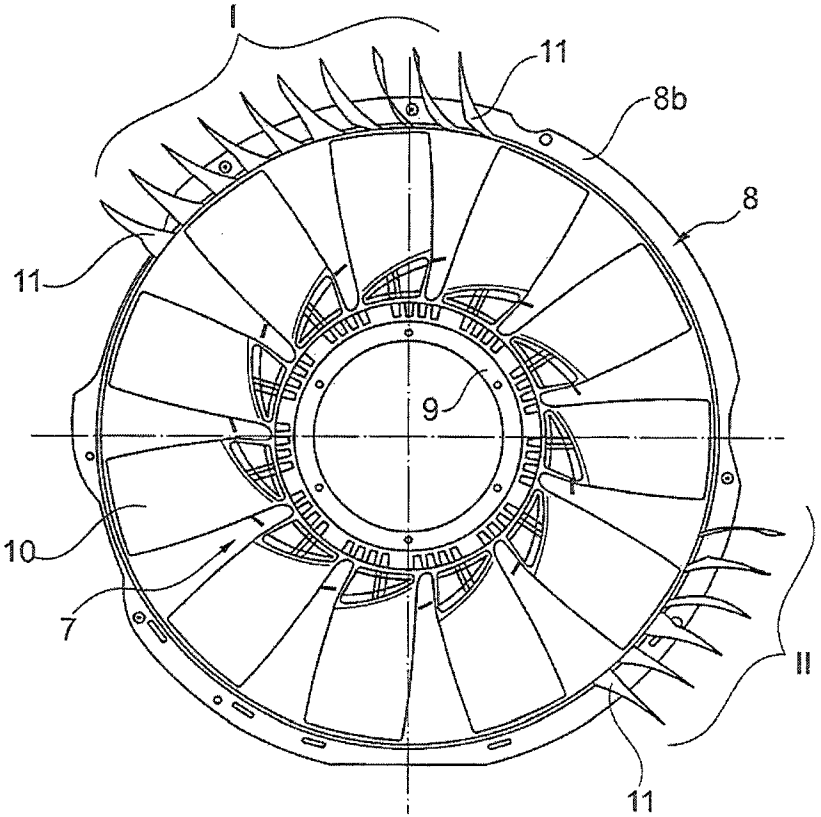
FIG. 2*a* illustrates a second exemplary embodiment of the invention with flow guidance elements partially arranged in the circumferential region of an axial flow fan in a view from the rear.

FIG. 2*a* and FIG. 2*b* show as a second exemplary embodiment of the invention an axial flow fan 7, which rotates in a shroud ring 8 that is arranged in a stationary, preferably engine-mounted manner. The axial flow fan 7 has fan blades 10 attached to a fan hub 9, which fan blades extend in the axial direction over a depth T (FIG. 2*b*). The shroud ring 8 has a region 8*a* embodied in a cylindrical manner, which encases the fan blades 10 in their upstream region and is approximately flush with an air inlet plane EE. The fan blades 10 project in the air flow direction L beyond the cylindrical region 8*a* and form a blade overhang Ü, which preferably lies in a region of 15 to 60% of the depth T of the fan blades 10. The fan blades 10 are thus not encased in the region of the blade overhang Ü, i.e., the blade tips 10*a* run freely. In the axial region of the blade overhang Ü, a flow guidance element 11 is arranged radially outside the blade tip 10*a*, which flow guidance element additionally is shown as a flow guidance element 11*a* in a view from below and as a flow guidance element 11*b* in a view from the rear. It is shown by the representations 11, 11*a*, 11*b* that the flow guidance element 11 is curved in a three-dimensional manner, i.e., parallel radial sections (perpendicular to the fan axis) through the flow guidance element 11 have different curvatures, in particular a twist in the axial direction.

FIG. 2*a* shows in a view from the rear the arrangement of the flow guidance elements 11 on the circumference of the shroud ring 8. A first group I of ten flow guidance elements 11 (the number 10 applies as an example) is arranged in the upper region of the axial flow fan 7, and a second group II of six flow guidance elements 11 (the number 6 is likewise an example) is arranged in the lower lateral region of the axial flow fan 7. To attach the flow guidance elements 11, the shroud ring 8 has flange sections 8*b* running radially. The arrangement of the flow guidance elements 11 in groups I, II, i.e., distributed in sections over the circumference of the shroud ring 8, is carried out in adaptation to the outflow field lying behind the axial fan 7 and disturbed by obstructions to flow. A targeted effective influence of the fan outflow is thus realized, namely through the selective arrangement of the flow guidance elements 11 on the circumference, through the number thereof on a circumferential section as well as optionally through a different geometry (curvature) of the guide surfaces of the flow guidance elements 11. Therefore the latter do not need to have an identical geometry, although they are labeled by the same reference number 11.

Figure 3:
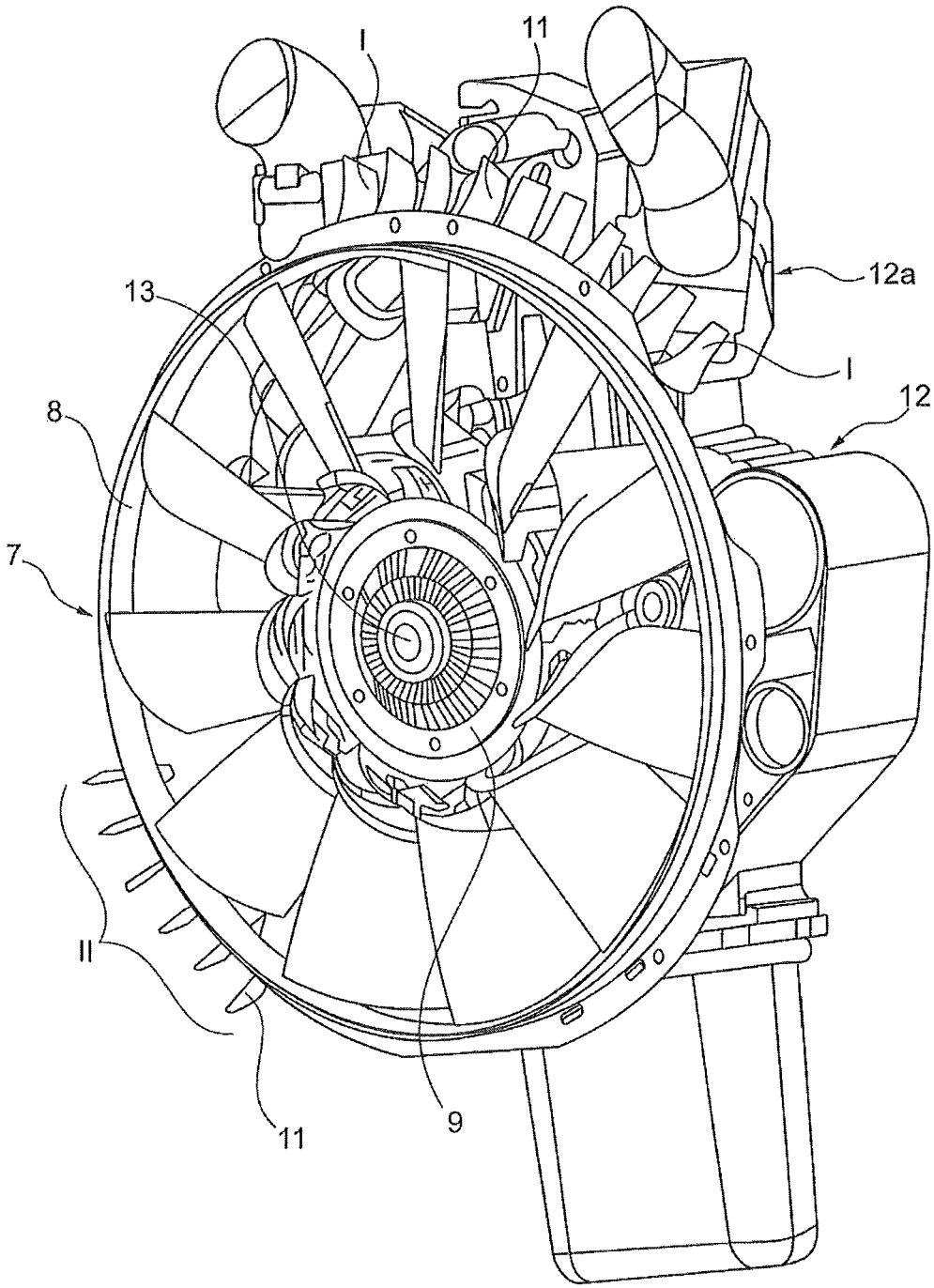
FIG. 3 is perspective view of the axial flow fan with partial flow guidance elements from the front with rear internal combustion engine.

FIG. 3 shows a perspective view from the front of the axial flow fan 7 according to FIG. 2*a* and FIG. 2*b* including the shroud ring 8 and the flow guidance elements 11 attached thereto and arranged in groups I, II. The axial flow fan 7 is attached to an internal combustion engine 12 and is driven via a crankshaft (not shown) and a fan clutch 13 connected to the fan hub 9. The shroud ring 8 as well as the flow guidance elements 11 attached thereto can—which is not shown—likewise be connected to the internal combustion engine 12. This provides the advantage that a narrow peripheral gap can be maintained between the axial flow fan 7 and the shroud ring 8. The internal combustion engine 12 is located in the outflow field of the axial flow fan 7 and represents a considerable interference obstacle for the exiting fan flow. A "blocking" of the fan outflow field is present in particular in the upper region 12*a*. For this reason, the flow guidance elements 11 are arranged in a group I particularly in the upper region of the axial flow fan 7. The "blocking" by the upper region 12*a* of the internal combustion engine 12 is thus "neutralized" in that the air flow exiting from the fan 7 in the region 12*a* is deflected in a targeted manner in a radial flow direction or also in a radial and a tangential flow direction. The fan exit air can thus be guided out of the engine compartment in a targeted manner past the mentioned obstacles to flow and with greatly reduced pressure losses. Furthermore, in this manner a recirculation and renewed induction of air already heated can be avoided. Through the second group II of flow guidance elements 11 in a circumferential region, which is arranged approximately diametrically to the arrangement of the first group I, a locally limited influence of the fan outflow adapted to the outflow flow conditions is likewise achieved. The arrangement of the groups I, II is shown by an exemplary embodiment out of many possibilities, i.e., with a deviating "silhouette" of the internal combustion engine and its additional units, a deviating arrangement and design of the air guidance elements can be necessary.

Deviating from the exemplary embodiments shown, in which the axial flow fan is arranged in an engine-mounted manner and is driven by the internal combustion engine, an embodiment variant is also within the scope of the invention in which the axial flow fan is arranged in a "radiator-mounted" manner, i.e., connected to a heat exchanger embodied as a coolant radiator via a radiator shroud (also referred to as a fan cowl) and is attached with respect thereto. In this case, the drive of the axial flow fan would preferably take place via an electric motor also connected to the fan cowl.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An axial flow fan, which is arranged in a rotatable manner around an axis in a stationary shroud ring, the axial fan comprising fan blades partially encased within the shroud ring, wherein the shroud ring has an essentially cylindrical annular surface with an axial extension from a leading edge to a trailing edge and the fan blades have an axial depth from an inflow edge to an outflow edge, wherein the outflow edges of the fan blades in the axial direction project beyond the trailing edge of the annular surface and form a blade overhang, wherein flow guidance elements are arranged radially outside the fan blades as well as in an axial region of the blade overhang, wherein the flow guidance elements have trailing edges, which are arranged in a same radial plane as an axially outermost outflow edge of the fan blades, and wherein the flow guidance elements are disposed on and extend from an outflow end of the shroud ring.

2. The axial flow fan according to claim 1, wherein the flow guidance elements are arranged radially or radially and tangentially over the circumference on the stationary shroud ring.

3. The axial flow fan according to claim 2, wherein the flow guidance elements have curved guide surfaces.

4. The axial flow fan according to claim 3, wherein the guide surfaces are curved in a two-dimensional manner.

5. The axial flow fan according to claim 3, wherein the guide surfaces are curved in a three-dimensional manner.

6. The axial flow fan according to claim 1, wherein the flow guidance elements are arranged in sections on a circumference of the shroud ring and are adapted to a local outflow field behind the axial flow fan.

7. The axial flow fan according to claim 1, wherein the flow guidance elements have an axial extension that corresponds to the blade overhang.

8. The axial flow fan according to claim 1, wherein the shroud ring is a diffuser on an outflow side.

9. The axial flow fan according to claim 1, wherein the flow guidance elements are attached to the shroud ring individually or as groups.

10. The axial flow fan according to claim 8, wherein the flow guidance elements are configured as one piece with the shroud ring as a plastic injection molded part.

11. The axial flow fan according to claim 1, wherein the axial flow fan is attached to an internal combustion engine of a motor vehicle and is configured to be drivable by the internal combustion engine.

12. The axial flow fan according to claim 10, wherein the shroud ring and the flow guidance elements are attached to the internal combustion engine.

13. The axial flow fan according to claim 1, wherein the axial flow fan, the shroud ring and the flow guidance elements are attached to a fan cowl of a heat exchanger or a coolant radiator for an internal combustion engine of a motor vehicle.

14. The axial flow fan according to claim 12, wherein the axial flow fan is configured to be driven by an electric motor attached to the fan cowl.

15. The axial flow fan according to claim 1, wherein the fan blades extend beyond an outflow end of the shroud ring.

16. The axial flow fan according to claim 1, wherein the fan blades are partially encased within the shroud ring in an axial direction with respect to the fan.

17. The axial flow fan according to claim 1, wherein the flow guidance elements form vane-shaped cylindrical surfaces.

18. The axial flow fan according to claim 1, wherein an outflow side of the shroud ring has a conical shape.

19. The axial flow fan according to claim 1, wherein the blade overhang corresponds to 15% to 60% of an entire depth of the fan blades.

20. An apparatus, comprising:

a shroud ring; and an axial flow fan arranged in a rotatable manner around an axis of the stationary shroud ring, the axial flow fan comprising:

fan blades partially encased within the shroud ring, wherein the shroud ring has an essentially cylindrical annular surface with an axial extension from a leading edge to a trailing edge and the fan blades have an axial depth from an inflow edge to an outflow edge, wherein the outflow edges of the fan blades in the axial direction project beyond the trailing edge of the annular surface and form a blade overhang, wherein flow guidance elements are arranged radially outside the fan blades as well as in an axial region of the blade overhang, wherein the flow guidance elements have trailing edges, which are arranged in a same radial plane as an axially outermost outflow edge of the fan blades, and wherein the flow guidance elements are disposed on and extend from an outflow end of the shroud ring.

21. An apparatus, comprising:

a shroud ring having an inflow end and an outflow end;

an axial flow fan arranged in the shroud ring, the axial fan comprising fan blades partially encased within the shroud ring between the inflow end and the outflow end, the fan blades comprising an outflow edge projecting out from the outflow end of the shroud ring to form a blade overhang; and flow guidance elements disposed on and extending from the outflow end of the shroud ring, wherein the flow guidance elements have trailing edges, which are arranged in a same radial plane as an axially outermost outflow edge of the fan blades, and wherein the flow guidance elements are disposed on and extend from an outflow end of the shroud ring.

* * * * *